US008127780B2

(12) United States Patent
Tung

(10) Patent No.: US 8,127,780 B2
(45) Date of Patent: Mar. 6, 2012

(54) TELESCOPIC SUNSHADE

(76) Inventor: Benson Tung, Kaohsiung (TW)

( * ) Notice: Subject to any disclaimer, the term of this patent is extended or adjusted under 35 U.S.C. 154(b) by 164 days.

(21) Appl. No.: 12/780,992

(22) Filed: May 17, 2010

(65) Prior Publication Data

US 2011/0277800 A1 Nov. 17, 2011

(51) Int. Cl.
*A45B 25/14* (2006.01)

(52) U.S. Cl. ..... 135/20.3; 135/39; 135/43; 135/98

(58) Field of Classification Search ..... 135/98, 135/15.1, 20.2, 22, 24, 37, 39, 43
See application file for complete search history.

(56) References Cited

U.S. PATENT DOCUMENTS

| | | | | |
|---|---|---|---|---|
| 229,685 | A * | 7/1880 | Ege | 135/28 |
| 5,188,137 | A * | 2/1993 | Simonelli | 135/19.5 |
| 6,082,383 | A * | 7/2000 | Wilson | 135/41 |
| 7,798,161 | B2 * | 9/2010 | Ma | 135/28 |
| 7,963,293 | B2 * | 6/2011 | Ma | 135/20.3 |
| 2006/0151018 | A1 * | 7/2006 | Wilson | 135/16 |
| 2006/0151019 | A1 * | 7/2006 | Lo | 135/20.3 |
| 2010/0269871 | A1 * | 10/2010 | Ma | 135/20.3 |

FOREIGN PATENT DOCUMENTS

EP 1236414 A2 * 9/2002

* cited by examiner

*Primary Examiner* — Winnie Yip
(74) *Attorney, Agent, or Firm* — Alan Kamrath; Kamrath IP Law Firm, PA

(57) ABSTRACT

A telescopic sunshade includes an outer tube having upper and lower positioning holes. An inner tube is slideably received in the outer tube and includes an upper end beyond the outer tube. Ribs are pivotably mounted to a hub fixed to the inner tube. Stretchers are pivotably mounted between the ribs and the outer tube. The sunshade is in a folded state when the inner tube is in an upper position. The sunshade is in an unfolded position when the inner tube is in a lower position. The protruded length of the inner tube in the upper position is larger than that in the lower position. A sleeve is slideably mounted around the outer tube and engaged with the inner tube to move therewith. A positioning button is engaged in the upper or lower positioning hole to retain the sunshade in the folded or unfolded state.

8 Claims, 14 Drawing Sheets

TELESCOPIC SUNSHADE

BACKGROUND OF THE INVENTION

The present invention relates to a sunshade and, more particularly, to a telescopic sunshade that are generally used outdoors and that e that can be easily and rapidly unfolded with less effort and that can be easily and rapidly unfolded with less effort.

A type of outdoor sunshade includes a post located on the ground and a plurality of ribs each having an end pivotably connected to a top end of the post. A runner is slideably mounted to the post. A plurality of stretchers is pivotably connected between the runner and the ribs, allowing the sunshade to move between a folded state and an unfolded state. A reel device is mounted to the post to assist in folding and unfolding of the bulky sunshade. Namely, folding and unfolding operations are labor-saving but take a longer time such that the user may get a wetting by sudden rain due to failing to rapidly unfold the sunshade.

Thus, a need exists for a sunshade that can be easily and rapidly unfolded with less effort.

BRIEF SUMMARY OF THE INVENTION

The present invention solves this need and other problems in the field of easy and rapid operation of sunshades by providing, in a preferred form, a telescopic sunshade including an outer tube having a first end and a second end spaced from and below the first end along a first axis perpendicular to a surface. The outer tube is adapted to be placed on the surface. A first longitudinal hole extends from the first end through the second end of the outer tube along the first axis. The outer tube further includes an outer periphery extending between the first and second ends of the outer tube. A restraining slot extends from the outer periphery of the outer tube through the first longitudinal hole in a radial direction perpendicular to the first axis. The restraining slot includes a first end and a second end spaced from and below the first end of the restraining slot along the first axis. Upper and lower positioning holes extend from the outer periphery of the outer periphery of the outer tube in the radial direction and spaced from the restraining slot by an angle in a circumferential direction about the first axis. An inner tube is slideably received in the first longitudinal hole of the outer tube between upper and lower positions spaced along the first axis. The inner tube includes upper and lower ends spaced along the first axis and an outer periphery extending between the upper and lower ends of the inner tube. A second longitudinal hole extends from the upper end through the lower end of the inner tube along the first axis. A through-hole extends from the outer periphery at the lower end of the inner tube through the second longitudinal hole in the radial direction perpendicular the first axis. The upper end of the inner tube protrudes upward beyond and has a spacing to the first end of the outer tube along the first axis when the inner tube is in either of the upper and lower positions. The lower end of the inner tube is located in the outer tube when the inner tube is in either of the upper and lower positions. The spacing between the first end of the outer tube and the upper end of the inner tube in the upper position is longer than that between the first end of the outer tube and the upper end of the outer tube in the lower position.

The telescopic sunshade further includes a positioning button slideably received in the through-hole of the inner tube between a retracted position received in one of the upper and lower positioning holes and a protruded position partially extending outside of one of the upper and lower positioning holes. The positioning button is biased from the retracted position to the protruded position. The positioning button is aligned with the upper positioning hole when the inner tube is in the upper position. The positioning button is aligned with the lower positioning hole when the inner tube is in the lower position. A hub is fixed to the upper end of the inner tube to move therewith. A plurality of ribs each have an end pivotably connected to the hub. A runner is slideably mounted to the outer tube along the first axis and located above the restraining slot along the first axis. A plurality of stretchers each includes a first end pivotably connected to the runner and a second end pivotably connected to one of the plurality of ribs. A sleeve is slideably mounted around the outer tube along the first axis. The sleeve includes top and bottom ends spaced along the first axis and an outer periphery extending between the top and bottom ends of the sleeve. A central hole extends from the top end through the bottom end of the sleeve along the first axis. An opening extends through the outer periphery of the sleeve to the central hole in the radial direction perpendicular to the first axis. A first radial hole extends from the outer periphery of the sleeve through the central hole in the radial direction perpendicular to the first axis and spaced from the opening in the circumferential direction. The first radial hole is aligned with the restraining slot and within an extent of a length of the restraining slot along the first axis. The positioning button is located within an extent of the opening. A follower extends through the first radial hole of the sleeve and the restraining slot of the outer tube and is engaged with the inner tube, allowing joint sliding movement of the sleeve and the inner tube along the first axis restrained by the extent of the length of restraining slot.

When the inner tube is in the upper position, the telescopic sunshade is in a folded state. The positioning button is engaged in the upper positioning hole when the positioning button is in the protruded position. The positioning button is movable to the retracted position to disengage from the upper positioning hole to allow the inner tube to move from the upper position to the lower position together with the hub and the plurality of ribs.

When the inner tube is in the lower position, the telescopic sunshade is supported in an unfolded state by the plurality of ribs and the plurality of stretchers. The positioning button is engaged in the lower positioning hole when the positioning button is in the protruded position. The positioning button is movable to the retracted position to disengage from the lower positioning hole to allow the inner tube to move from the lower position to the upper position together with the hub and the plurality of ribs.

In the most preferred form, a jacket is rotatably mounted around the sleeve between a release position not pressing the positioning button and a pressing position pressing the positioning button. The jacket includes upper end and lower ends spaced along the first axis. A compartment extends from the upper end through the lower end of the jacket along the first axis. A pressing block is formed on an inner periphery of the compartment and within the extent of the opening. The pressing block is spaced from the positioning button in the circumferential direction when the jacket is in the release position. The pressing block moves the positioning button from the protruded position to the retracted position when the jacket is moving from the release position to the pressing position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
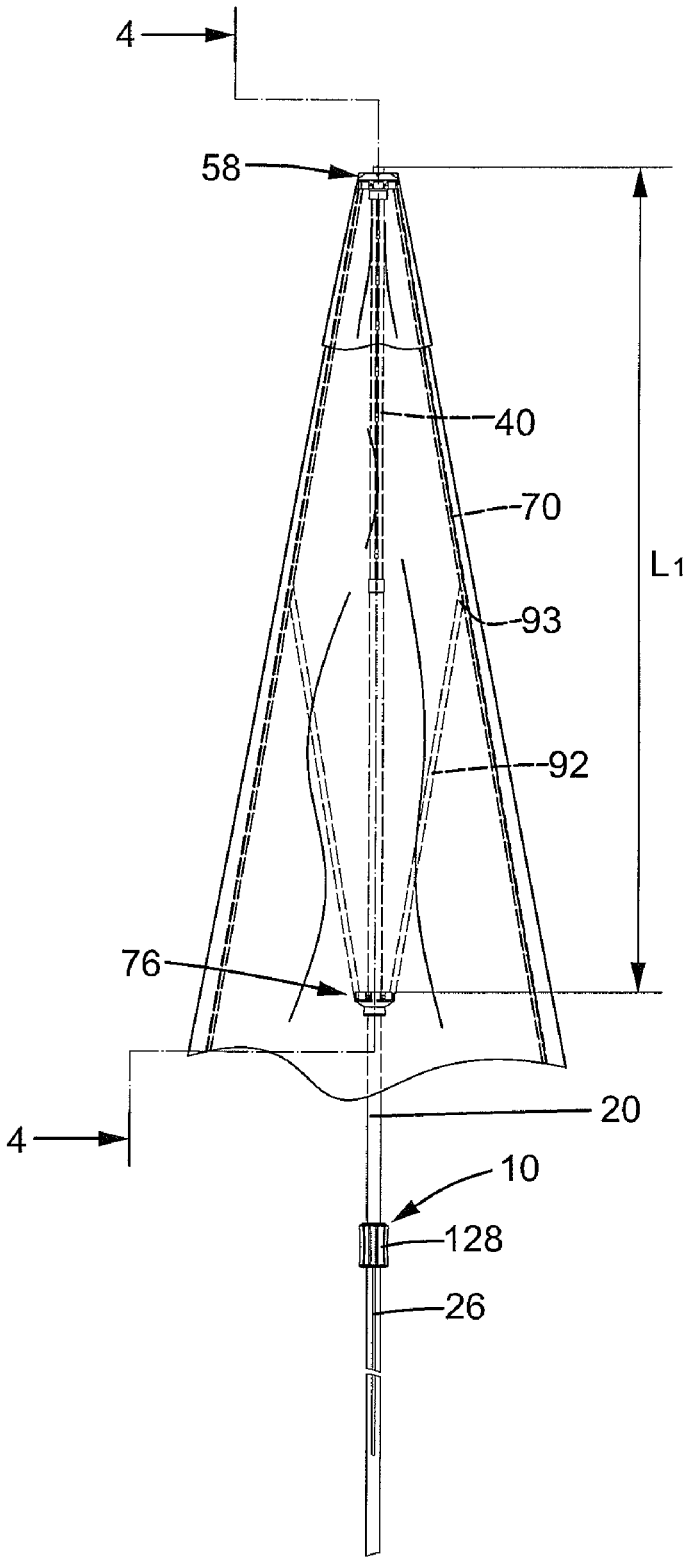
FIG. 1 shows a diagrammatic side view of a telescopic sunshade according to the preferred teachings of the present invention in a folded state.
Figure 2:
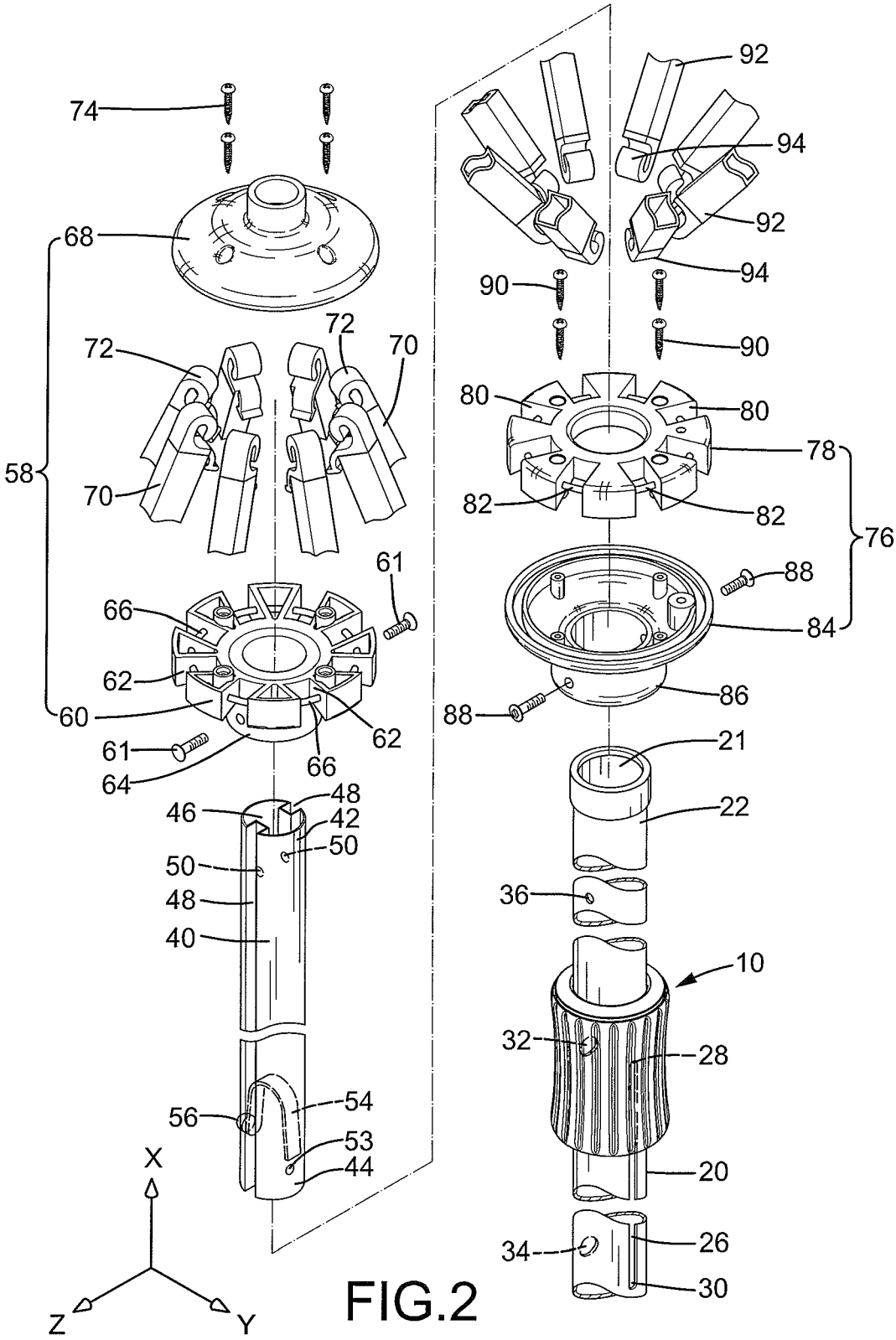
FIG. 2 shows a partial, exploded, perspective view of the telescopic sunshade of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "inner", "outer", "top", "bottom", "side", "end", "portion", "section", "longitudinal", "axial", "radial", "circumferential", "lateral", "vertical", "annular", "spacing", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A telescopic sunshade according to the preferred teachings of the present invention is shown in the drawings and generally used outdoors and located on a surface such as the ground. According to the preferred form shown, the telescopic sunshade includes an outer tube 20 having first and second ends 22 and 24 spaced along a first axis X perpendicular to the ground. Outer tube 20 includes a longitudinal hole 21 extending from first end 22 through second end 24 that is below first end 22. Outer tube 20 includes an outer periphery extending between first and second ends 22 and 24. Outer tube 20 further includes a restraining slot 26 extending from the outer periphery of outer tube 20 through longitudinal hole 21 in a radial direction perpendicular to first axis X. Restraining slot 26 includes first and second ends 28 and 30 spaced along first axis X with first end 28 above second end 30. Outer tube 20 further includes upper and lower positioning holes 32 and 34 each extending from the outer periphery of outer tube 20 through longitudinal hole 21 in the radial direction. In the most preferred form shown, each of upper and lower positioning holes 32 and 34 is spaced from restraining slot 26 by 180° in a circumferential direction about first axis X. Furthermore, each of upper and lower positioning holes 32 and 34 is aligned with restraining slot 26 along a second axis Y perpendicular to first axis X. Furthermore, upper positioning hole 32 is above first end 28 of restraining slot 26 along first axis X, and lower positioning hole 34 is above second end 30 of restraining slot 26 along first axis X. Two fixing holes 36 extend from the outer periphery of outer tube 20 through longitudinal hole 21 and are located above upper positioning hole 32. Each fixing hole 36 is spaced from each of upper and lower positioning holes 32 and 34 by 90° in the circumferential direction about first axis X. Further, fixing holes 36 are aligned with each other along a third axis Z perpendicular to first and second axes X and Y.

According to the preferred form shown, the telescopic sunshade further includes an inner tube 40 slideably received in longitudinal hole 21 of outer tube 20 along first axis X. Inner tube 40 includes upper end lower ends 42 and 44 spaced along first axis X and a longitudinal hole 46 extending from upper end 42 through lower end 44. Inner tube 40 includes an outer periphery extending between upper and lower ends 42 and 44. Two diametrically opposed longitudinal grooves 48 are formed in the outer periphery of inner tube 40. In the most preferred form shown, longitudinal grooves 48 are spaced from and aligned with each other along third axis Z and each extend from upper end 42 through lower end 44 of inner tube 40 along first axis X. Lower end 44 of inner tube 40 includes a through-hole 52 (FIG. 5) extending from the outer periphery of inner tube 40 through longitudinal hole 46. In the most preferred form shown, lower end 44 of inner tube 40 further includes a radial hole 53 extending from the outer periphery of inner tube 40 through longitudinal hole 46 and spaced from through-hole 52 by 90° in the circumferential direction about first axis X. Furthermore, through-hole 52 is spaced from and aligned with radial hole 53 along second axis Y. Upper end 42 of inner tube 40 includes two engaging holes 50 each extending through a bottom wall of each longitudinal groove 48 to longitudinal hole 46. Engaging holes 50 in bottom walls of longitudinal grooves 48 are aligned with each other along third axis Z.

According to the preferred form shown, a positioning button 56 is mounted in longitudinal hole 46 of inner tube 40 and slideably received in through-hole 52 and having a domed end. An end of a resilient member 54 presses against an inner periphery of longitudinal hole 46. Positioning button 56 is fixed to the other end of resilient member 54. The dome end of positioning button 56 is biased to a protruded position beyond inner tube 40 by the resilient member 54. However, when the protruded portion of positioning button 56 is pressed, positioning button 56 can move towards longitudinal hole 46 to a retracted position in a direction perpendicular to first axis X.

Figure 12:
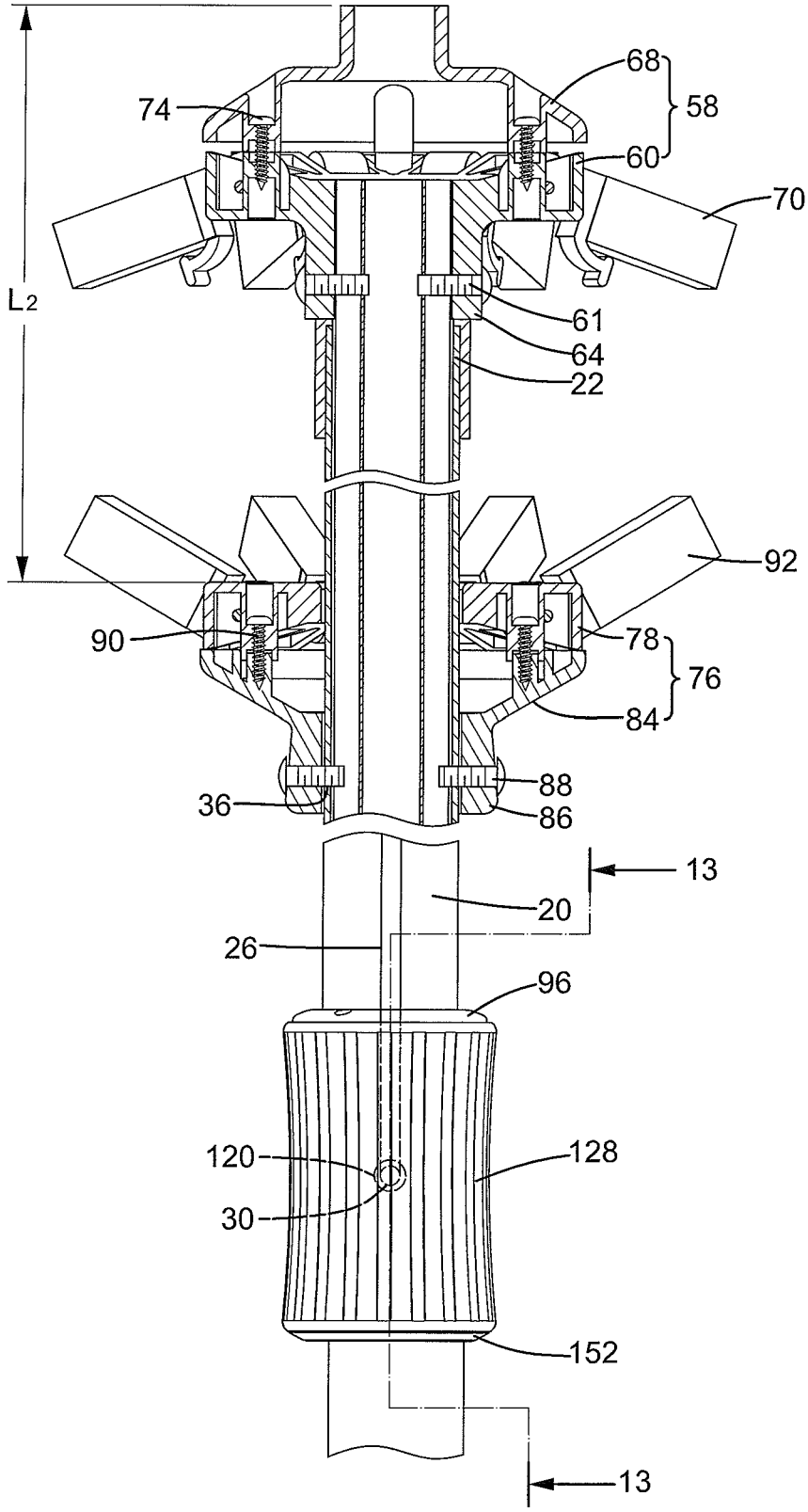
FIG. 12 shows a view similar to FIG. 4, with the inner tube moved from an upper position to a lower position.
Figure 13:
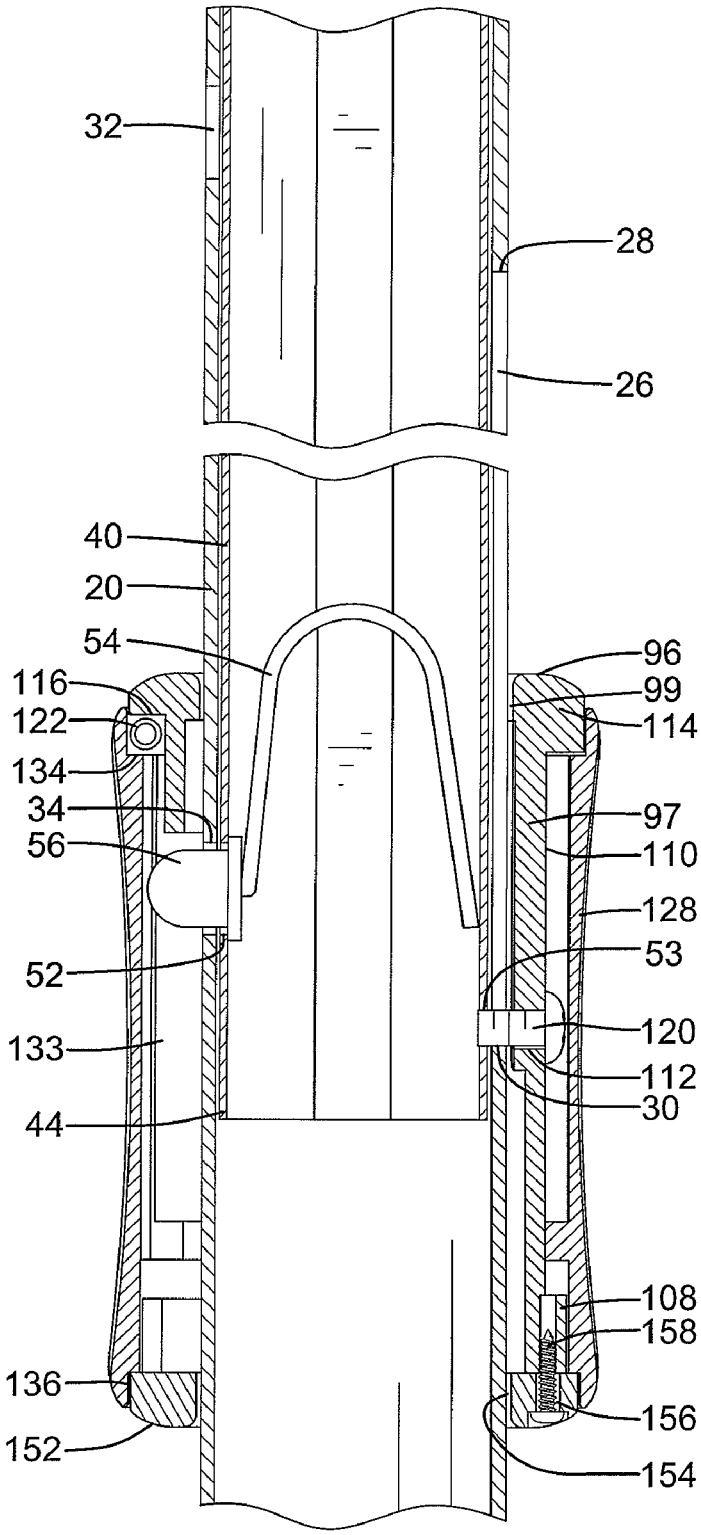
FIG. 13 shows a partial, cross-sectional view of the sunshade of FIG. 1 according to section line 13-13 of FIG. 12.
Figure 14:
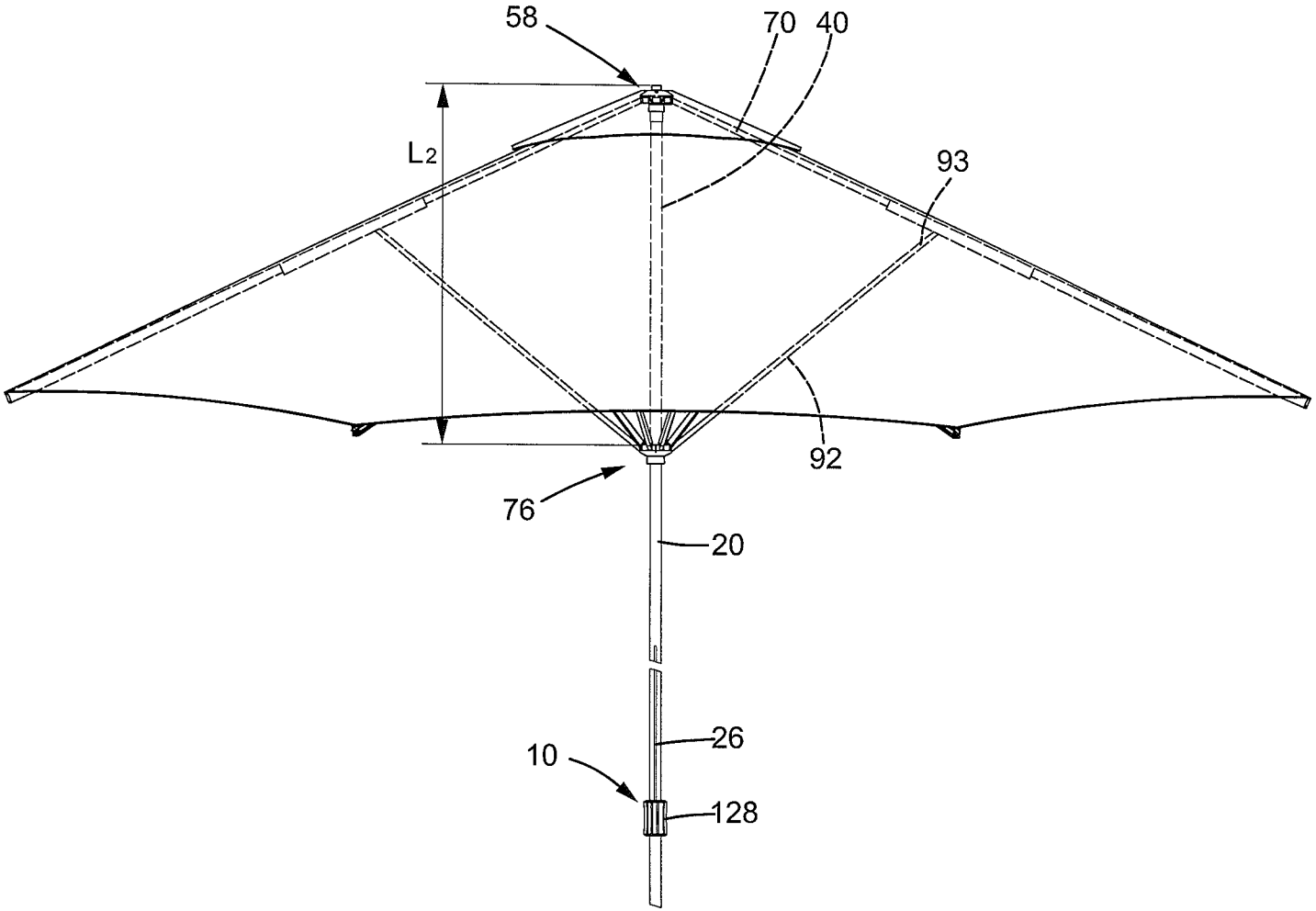
FIG. 14 shows a side view of the sunshade of FIG. 1 in an unfolded state.

After inner tube 40 is received in longitudinal hole 21 of outer tube 20, upper end 42 of inner tube 40 is above first end 22 of outer tube 20 (namely, inner tube 40 has a protruded length outside of outer tube 20), and lower end 44 is located in longitudinal hole 21. Each fixing hole 36 is aligned with one of longitudinal grooves 48. Positioning button 56 faces one of upper and lower positioning holes 32 and 34. Radial hole 53 faces restraining slot 26 and is within an extent of a length of restraining slot 26 along first axis X. Inner tube 40 is slideable relative to outer tube 20 along first axis between an upper position (FIGS. 1, 4, and 5) and a lower position (FIGS. 12-14). A spacing between first end 22 of outer tube 20 and upper end 42 of inner tube 40 in the upper position is larger than a spacing between first end 22 of outer tube 20 and upper end 42 of inner tube 40 in the lower position (i.e., the protruded length of inner tube 40 in the upper position is larger than that of inner tube 40 in the lower position). Radial hole 53 is within the extent of the length of the restraining slot 26 along first axis X regardless inner tube 40 is in upper or lower position.

According to the preferred form shown, the telescopic sunshade further includes a hub assembly 58 mounted to upper end 42 of inner tube 40. Hub assembly 58 includes a hub 60 having a plurality of annularly spaced pivotal grooves 62 each receiving a pin 66. Hub 60 includes a neck 64 at a lower portion thereof for engagement with upper end 42 of inner tube 40. Two fasteners 61 in the most preferred form shown as two screws are extended through neck 64 into engaging holes 50 of inner tuber 40 to fix hub 60 to upper end 42 of inner tube 40, allowing joint movement of hub 60 with inner tube 40 along first axis X between the upper and lower positions. A plurality of ribs 70 is provided and each includes a hooked end 72 received in one of pivotal grooves 62 and pivotably connected to one of pins 66. Hub assembly 58 further includes an upper cap 68 fixed by screws 74 to hub 60 for closing upper ends of pivotal grooves 62 and preventing ribs 70 from disengaging from pins 66. Ribs 70 can pivot between a folded position (FIG. 1) and an unfolded position (FIG. 14).

According to the preferred form shown, the telescopic sunshade further includes a runner assembly 76 fixed to outer tube 20. Runner assembly 76 includes a runner 78 having a plurality of annularly spaced pivotal grooves 80 each receiving a pin 82. A plurality of stretchers 92 is provided and each includes a first end 93 received in one of pivotal grooves 80 and pivotably engaged with one of pins 82. Each stretcher 92 further includes a second end 94 pivotably connected to an intermediate portion of one of ribs 70. It can be appreciated that stretchers 92 can be pivotably connected to positions other than the intermediate portions of ribs 70. Runner assembly 76 further includes a lower cap 84 having a skirt 86. Lower cap 84 is fixed by fasteners 90 to runner 78 to close lower ends of pivotal grooves 80 by skirt 86 and preventing first ends 93 of stretchers 92 from disengaging from pins 82. Two positioning members 88 in the most preferred form shown as two screws are extended through first end 22 of outer tube 20 into fixing holes 36 to fix runner assembly 76 to outer tube 20. An end of each positioning member 88 is received in one of longitudinal grooves 48 (FIG. 4) without interfering with sliding movement of inner tube 40 relative to outer tube 20 between the upper and lower positions.

Figure 3:
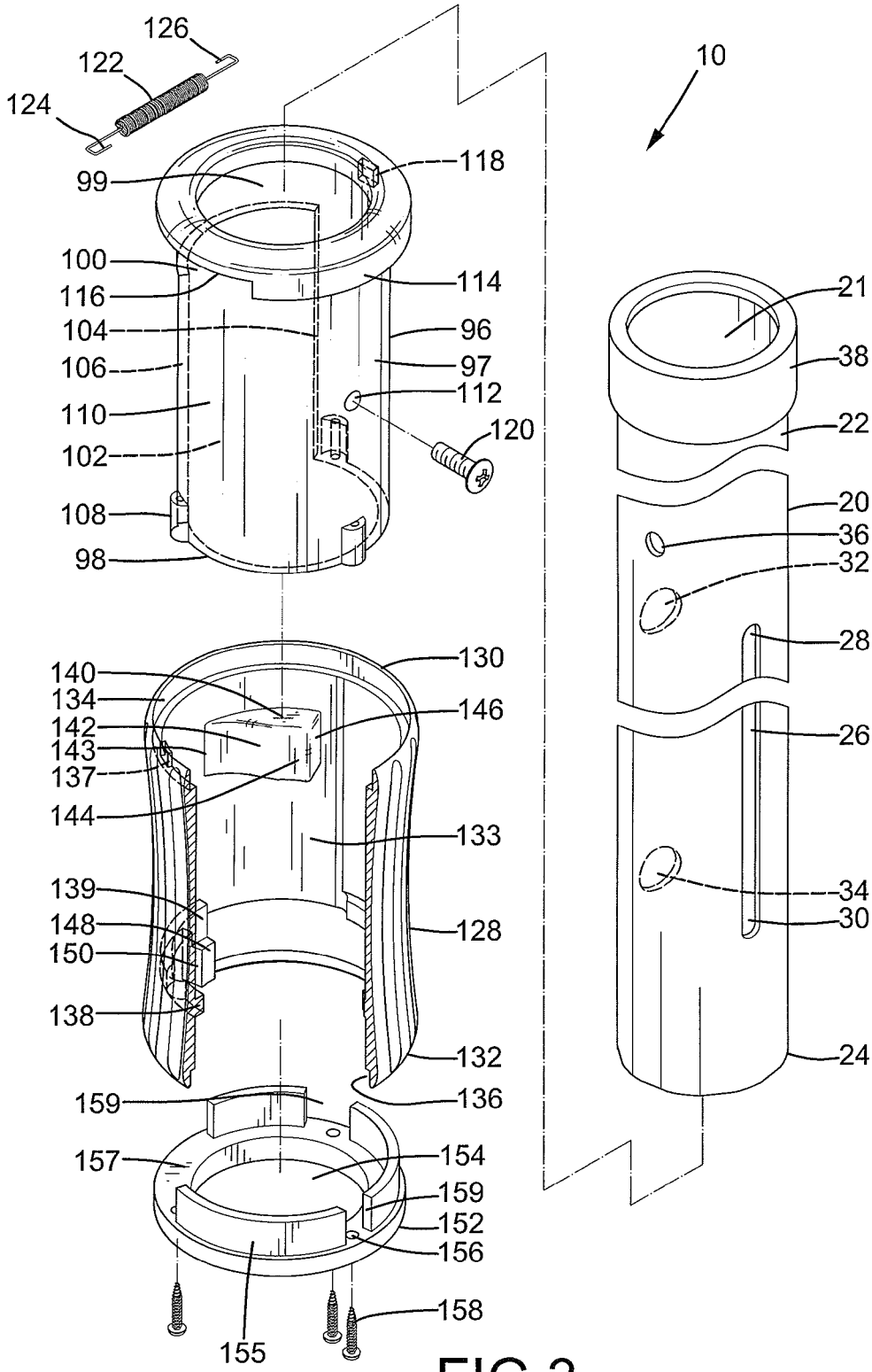
FIG. 3 shows an exploded, perspective view of a control device and an inner tube of the telescopic sunshade of FIG. 1.

According to the preferred form shown, the telescopic sunshade further includes a control device 10 having a sleeve 96 slideably mounted around outer tube 20. Sleeve 96 includes top and bottom ends 100 and 98 spaced along first axis X and a central hole 99 extending from top end 100 through bottom end 98. Sleeve 96 further includes an outer periphery 110 extending between top and bottom ends 100 and 98. An opening 102 extends from bottom end 98 towards but spaced from top end 100 along first axis X. In the most preferred form shown, opening 102 further includes first and second edges 104 and 106 spaced from each other by 120° in the circumferential direction about first axis X. A plurality of coupling blocks 108 is formed on outer periphery 110 at bottom end 98 of sleeve 96. A radial hole 112 extends from outer periphery 110 through central hole 99 along second axis Y and spaced from opening 102 in the circumferential direction. A flange 114 is formed on top end 100 of sleeve 96. A recess 116 is formed in a lower end of flange 114 and extends in the circumferential direction. Recess 116 includes two end faces spaced from each other by 230° in the circumferential direction about first axis X. A lug 118 (FIGS. 3 and 6) is formed adjacent one of the end faces of recess 116.

Outer tube 20 is received in central hole 99 of sleeve 96, allowing sleeve 96 to slide relative to outer tube 20 along first axis X. Radial hole 112 of sleeve 96 is aligned with and within the extent of restraining slot 26. Upper and lower positioning holes 32 and 34 of outer tube 20 and positioning button 56 of inner tube 40 are within the extent of opening 102. Outer tube 20 is located intermediate sleeve 96 and inner tube 40. A follower 120 in the most preferred form shown as a screw is extended through radial hole 112 of sleeve 96 and restraining slot 26 into radial hole 53 of inner tube 40, allowing joint sliding of sleeve 96 and inner tube 40 along first axis X. It is noted that movement of follower 120 along first axis X is limited by restraining slot 26. Thus, inner tube 40, hub assembly 58, and sleeve 96 are limited between the upper position (FIGS. 1, 4, and 5) and the lower position (FIGS. 12-14).

According to the preferred form shown, control device 10 further includes a jacket 128 mounted around sleeve 96. Jacket 128 includes upper and lower ends 130 and 132 spaced along first axis X and a compartment 133 extending from upper end 130 through lower end 132. Compartment 133 includes an upper enlarged section 134 at upper end 130 and a lower enlarged section 136 at lower end 132. A protrusion 137 is formed on an inner periphery of upper enlarged section 134. Another protrusion 138 is formed on an inner periphery of compartment 133 and adjacent to lower enlarged section 136. Protrusion 138 includes an arcuate inner surface 139 having a radius perpendicular to first axis X slightly larger than a radius of outer periphery 110 of sleeve 96 perpendicular to first axis X. Inner surface 139 of protrusion 138 includes a plurality of channels 135 spaced in the circumferential direction about first axis X. A stop 148 is formed on a bottom face of protrusion 138 and extends along the inner periphery of compartment 133. A pressing block 140 is formed on the inner periphery of compartment 133 and adjacent to upper enlarged section 134. Pressing block 140 includes a guide face 142, a pressing face 144, and a first stop face 146. First stop face 146 extends perpendicularly to first axis X. Pressing face 144 is connected to first stop face 146 and is an arcuate face extending in the circumferential direction and having a radius approximately the same as the radius of outer periphery 110 of sleeve 96. Pressing face 144 is coaxial to the inner periphery of compartment 133. Guide face 142 extends between pressing face 144 and the inner periphery of compartment 133 and has decreasing spacing from the inner periphery of compartment 133 towards pressing face 144, forming inclined guide face 142. Guide face 142 has a disengagement edge 143 flush with the inner periphery of compartment 133.

Figure 6:
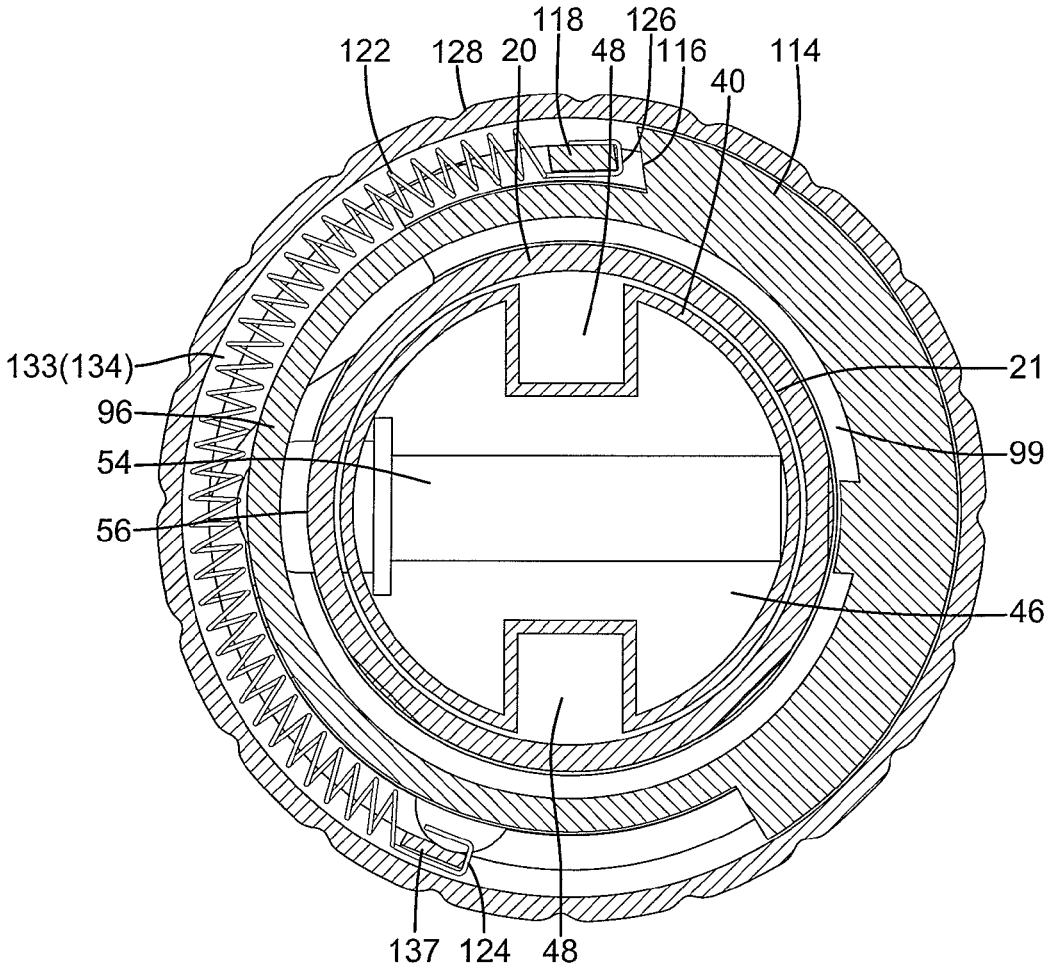
FIG. 6 shows a cross-sectional view of the sunshade of FIG. 1 according to section line 6-6 of FIG. 5.

When mounting jacket 128 around sleeve 96, flange 114 of sleeve 96 is received in upper enlarged section 134. Each coupling block 108 passes through protrusion 138 via one of channels 135 of jacket 128 to a position below protrusion 138. Inner surface 139 abutting outer periphery 110 of sleeve 96. Thus, jacket 128 is rotatable about first axis X. Pressing block 140 and stop 148 are within the extent of opening 102. First stop face 146 of pressing block 140 faces first edge 104 of opening 102. Stop 148 includes a second stop face 150 extending perpendicularly to first axis X and facing second edge 106 of opening 102. Positioning button 56 is at the same level as pressing block 140 along first axis X. Protrusion 137 is within the extent of recess 116. Recess 116 and upper enlarged section 134 together provide a space for receiving a spring 122 in the most preferred form shown as a tension spring having first and second tangs 124 and 126. First tang 124 is attached to protrusion 137. Second tang 126 is attached to lug 118 (FIG. 6). Jacket 128 is rotatable about first axis X between a pressing position (FIGS. 10 and 11) and a release position (FIGS. 7 and 8) defined by first stop face 146 of opening 102 and second stop face 150. Jacket 128 is biased by spring 122 from the pressing position to the release position.

According to the preferred form shown, control device 10 further includes a cap 152 having upper and lower surfaces and a hole 154 extending from the upper surface through the lower surface of cap 152. Cap 152 includes a plurality of fixing holes 156 surrounding hole 154. An extension 155 extends upward from the upper surface of cap 152 and includes two notches 159 and a compartment 157. Cap 152 is received in lower enlarged section 136 with each fixing hole 156 aligned with one of coupling blocks 108. Compartment 157 is aligned with opening 102. Extension 155 is received in compartment 133. Fasteners 158 are extended through fixing holes 156 into coupling blocks 108 to fix cap 152 in sleeve 96. Thus, jacket 128 is rotatably held between sleeve 96 and cap 152, avoiding jacket 128 from moving relative sleeve 96 along first axis X. Stop 148 is received in compartment 157 that provides a room for stop 148 to move while jacket 128 is moving between the release position and the pressing position.

Figure 4:
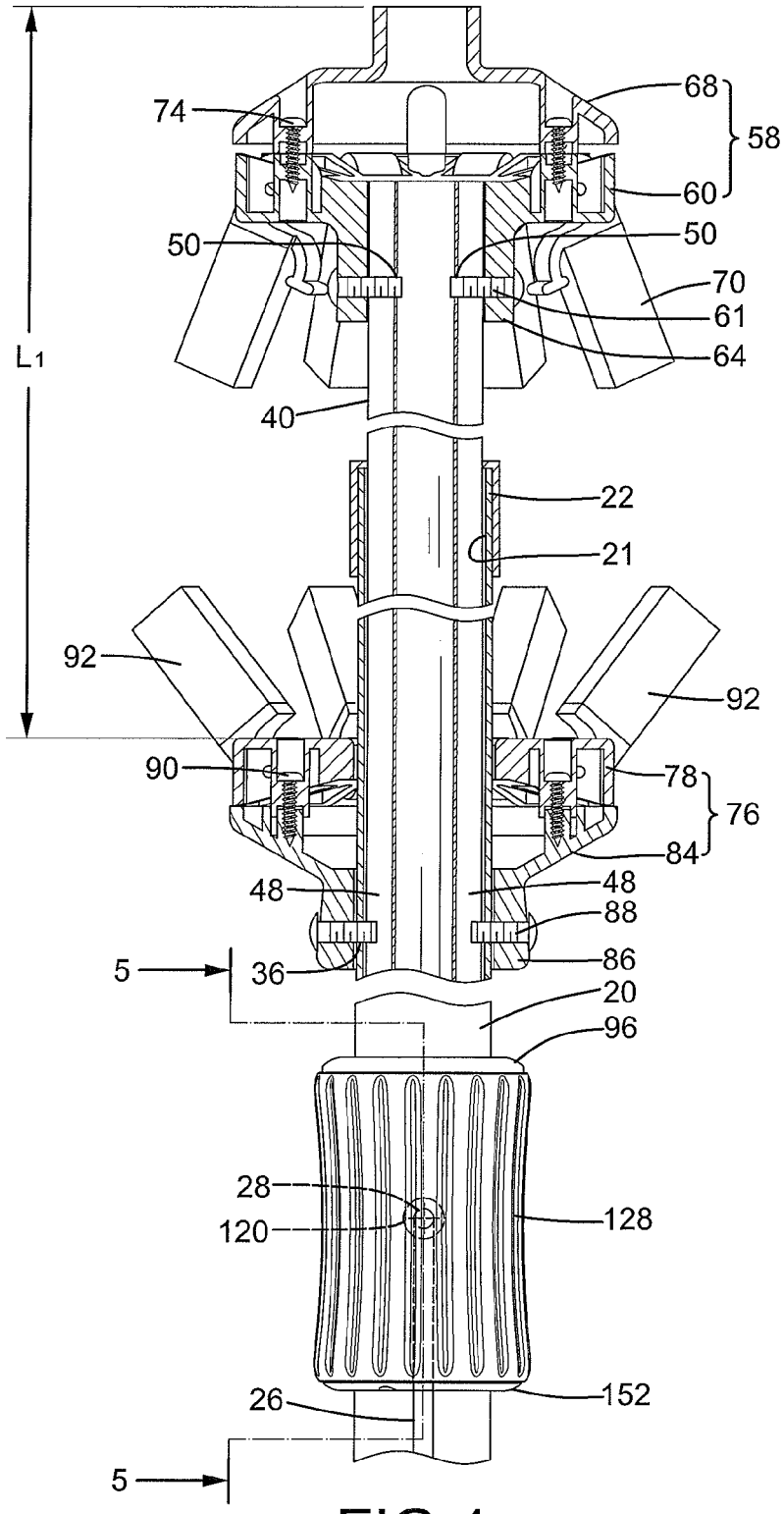
FIG. 4 shows a partial, cross-sectional view of the sunshade of FIG. 1 according to section line 4-4 of FIG. 1.
Figure 5:
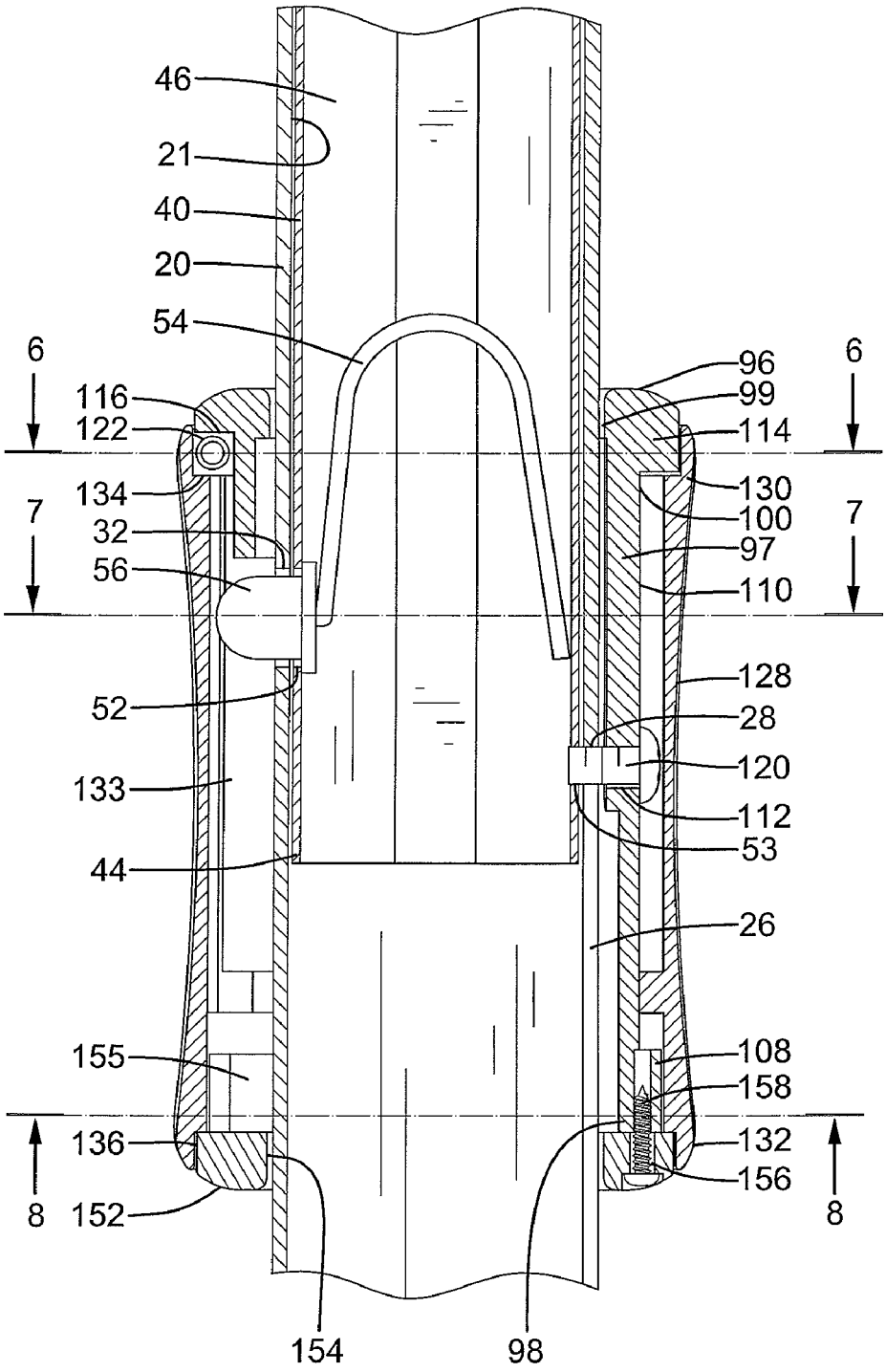
FIG. 5 shows a partial, cross-sectional view of the sunshade of FIG. 1 according to section line 5-5 of FIG. 4.
Figure 7:
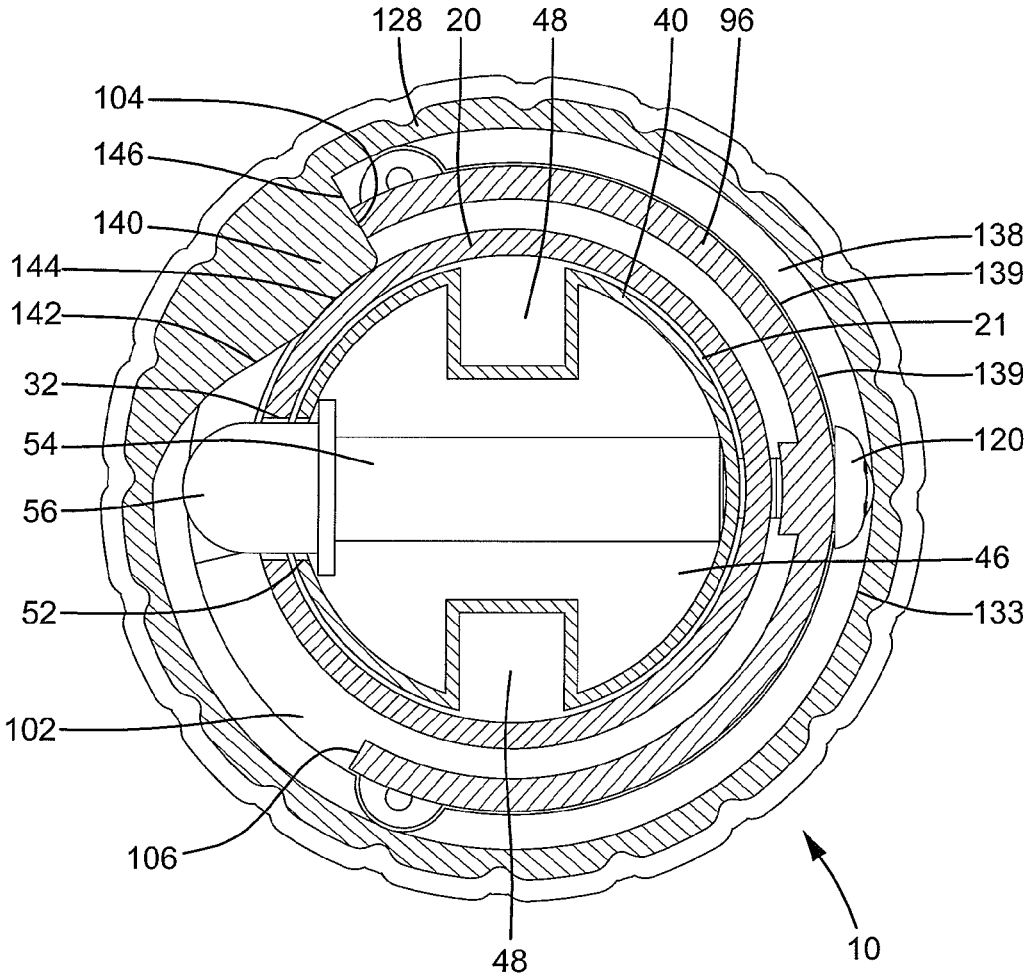
FIG. 7 shows a cross-sectional view of the sunshade of FIG. 1 according to section line 7-7 of FIG. 5.
Figure 8:
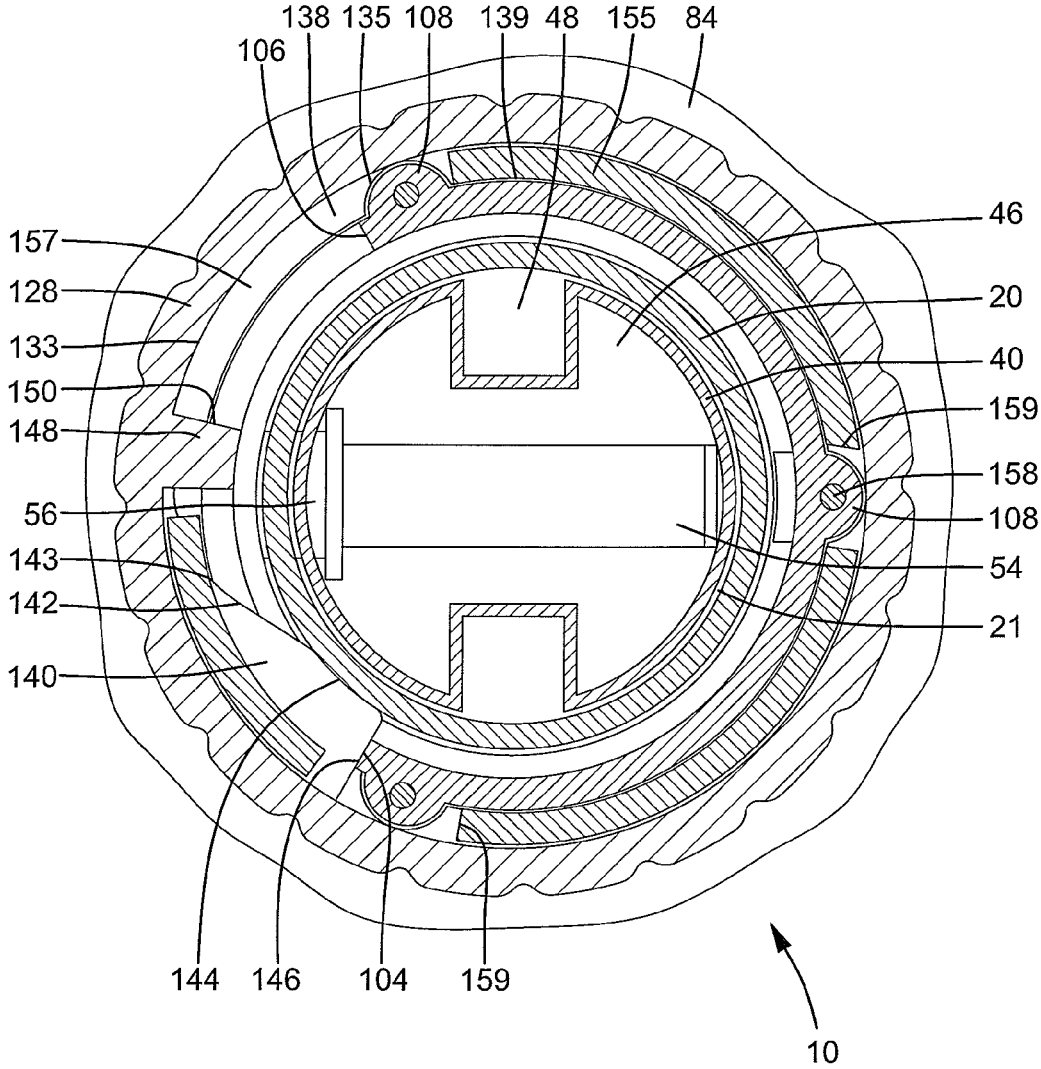
FIG. 8 shows a cross-sectional view of the sunshade of FIG. 1 according to section line 8-8 of FIG. 5.

Now that the basic construction of the telescopic sunshade of the preferred teachings of the present invention has been explained, the operation and some of the advantages of the telescopic sunshade can be set forth and appreciated. In particular, for the sake of explanation, it will be assumed that the telescopic sunshade is in a folded state with inner tube 40 in the upper position. The top side of hub assembly 58 has a spacing L1 (FIG. 4) to the bottom side of runner assembly 76. Positioning button 56 is in the protruded position engaged in upper positioning hole 32 (FIG. 5). Follower 120 is in first end 28 of restraining slot 26 (FIG. 5). Disengagement edge 143 of pressing block 140 of jacket 128 is aligned with positioning button 56. Jacket 128 is in the release position (FIG. 7). First stop face 146 of pressing block 140 abuts first edge 104 of opening 102 (FIG. 7). Note that runner assembly 76 is fixed on outer tube 20 that does not move. The overall length of the telescopic sunshade is the longest when inner tube 40 in the upper position.

Figure 9:
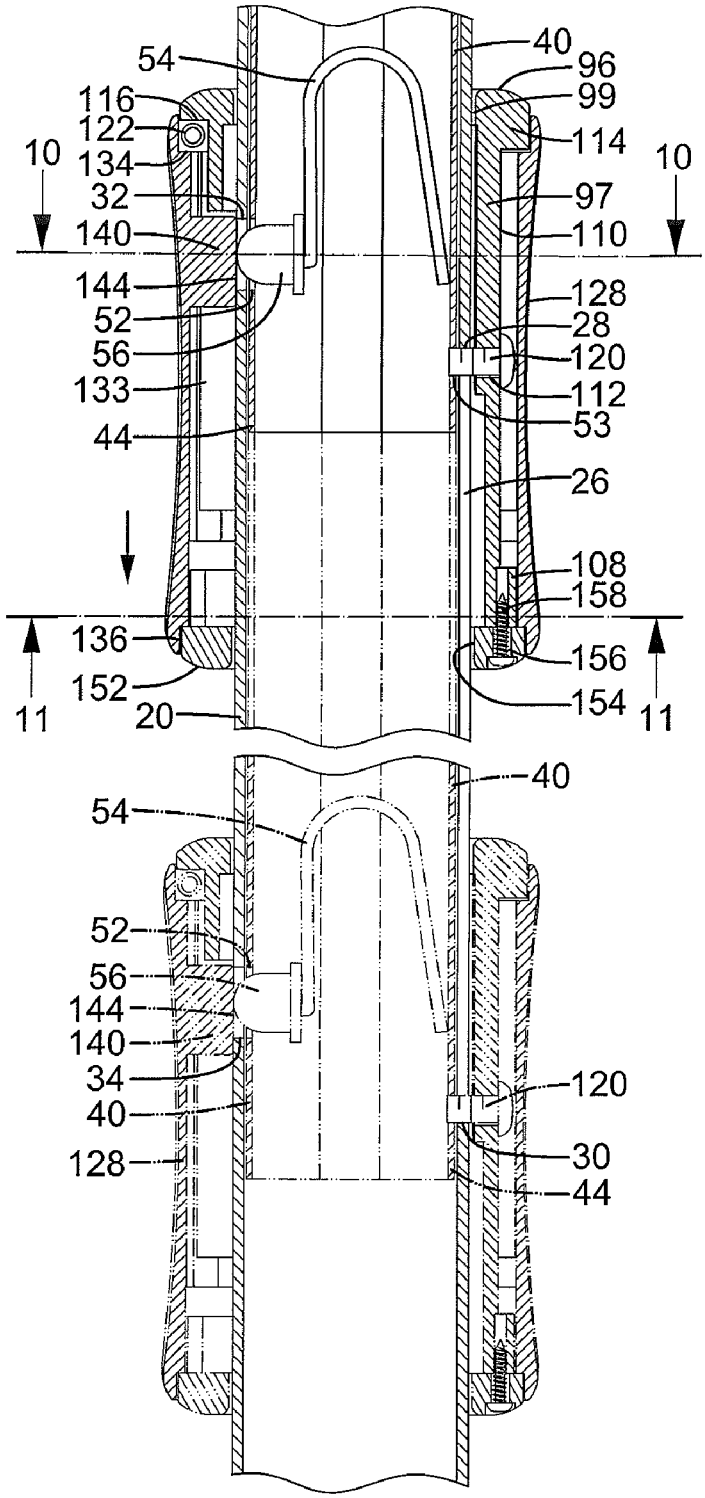
FIG. 9 shows a view similar to FIG. 5, with a jacket rotated to a pressing position pressing a positioning button.
Figure 10:
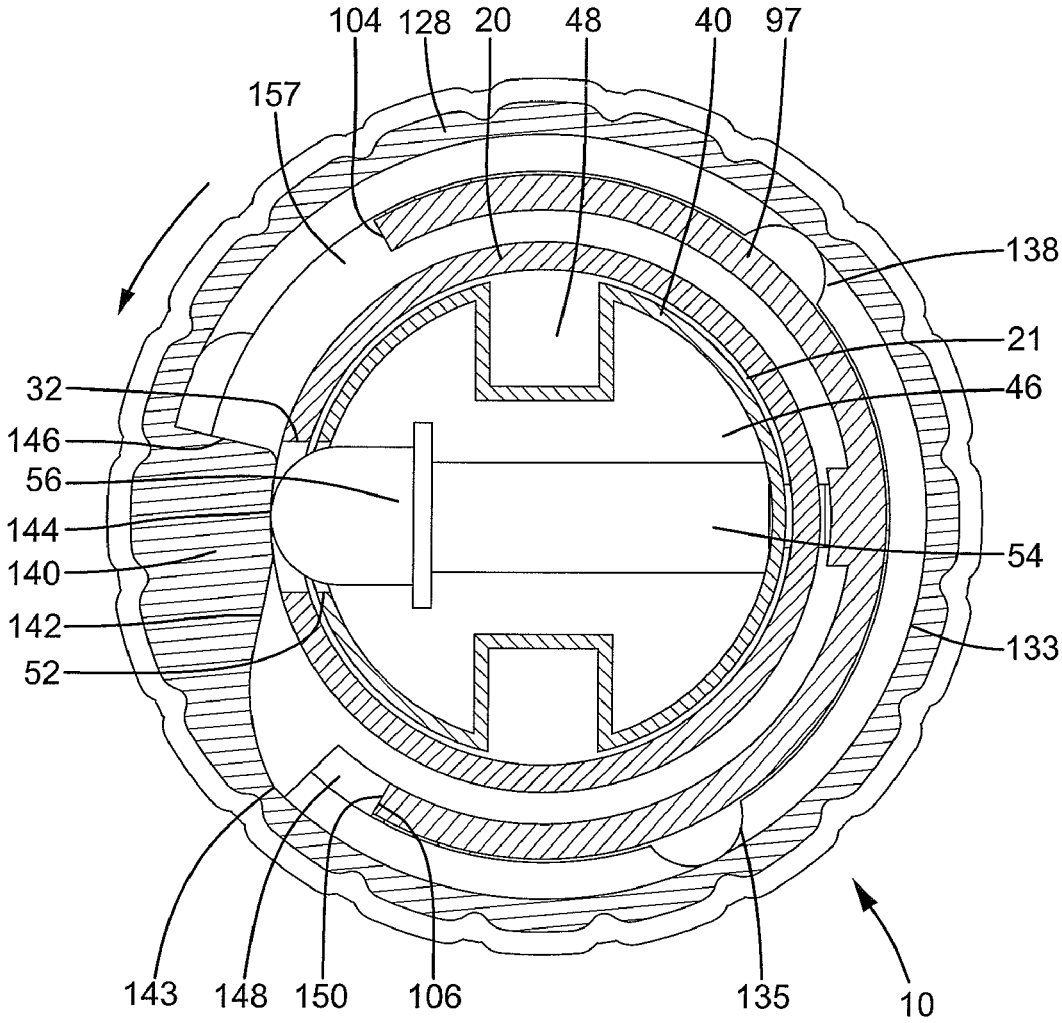
FIG. 10 shows a cross-sectional view of the sunshade of FIG. 1 according to section line 10-10 of FIG. 9.
Figure 11:
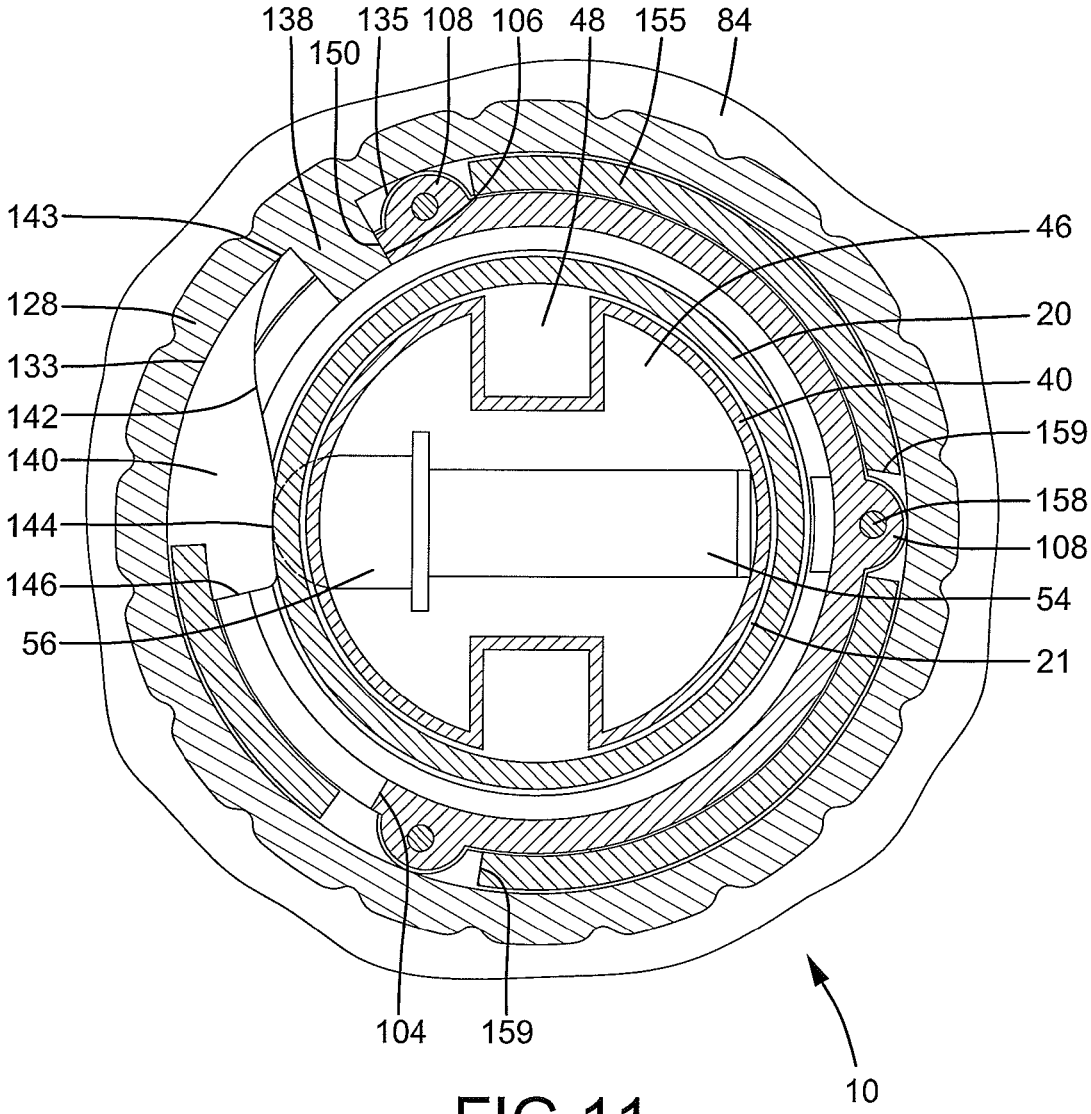
FIG. 11 shows a cross-sectional view of the sunshade of FIG. 1 according to section line 11-11 of FIG. 9.

When it is desired to unfold the telescopic sunshade, jacket 128 is rotated about first axis X from the release position (FIGS. 5-8) to the pressing position (FIGS. 9-11). Guide face 142 of pressing member 140 presses positioning button 56 towards the retracted position. When jacket 128 reaches the pressing position, pressing face 144 is aligned with and presses against positioning button 56 such that pressing button 56 is retained in the retracted position disengaged from upper positioning hole 32. The domed end of pressing button 56 allows smooth movement of pressing button 56 from the protruded position to the retracted position. It is appreciated that the domed end of pressing button 56 is now received in upper positioning hole 32. When jacket 128 is in the pressing position, second stop face 150 of stop 148 abuts second edge 106 of opening 102 (FIG. 11).

When jacket 128 is in the pressing position, control device 10 can be moved downward to move inner tube 40, hub assembly 58, and hooked ends 72 of ribs 70 along first axis X from the upper position (FIGS. 4, 5, and 9) to the lower position (FIGS. 12-14). When upper positioning hole 32 is moved relative to pressing button 56 along first axis X, the inner periphery of upper positioning hole 32 presses against pressing button 56 and, thus, causes disengagement of positioning button 56 from upper positioning hole 32.

Each stretcher 92 and each rib 70 are pivoted upward to unfold the telescopic sunshade while inner tube 40 is moving from the upper position to the lower position. When inner tube 40 reaches in the lower position, a spacing L2 between top side of hub assembly 58 has a spacing L2 (FIG. 14) to the bottom side of runner assembly 76 is smaller than the spacing L1 (FIGS. 1 and 4). Note that positioning button 56 is aligned with and retained in lower positioning hole 34 (see phantom lines in FIG. 9). Jacket 128 can then be released, and spring 122 rotates jacket 128 from the pressing position to the release position about first axis X. Disengagement edge 143 of pressing block 140 is aligned with positioning button 56 that is now biased by resilient member 54 into lower positioning hole 34 (FIG. 13) to retain inner tube 40 in the lower position and retaining the telescopic sunshade in the unfolded state (FIG. 14).

When it is desired to fold the telescopic sunshade, jacket 128 is rotated about first axis X from the release position to the pressing position to disengage positioning button 56 from lower positioning hole 34, allowing inner tube 40 to be moved from the lower position to the upper position by moving jacket 128 upward. When jacket 128 is released, spring 122 rotates jacket 128 from the pressing position to the release position about first axis X. Positioning button 56 is engaged in upper positioning hole 32 under the action of resilient member 54, retaining the telescopic sunshade in the folded state.

It can be appreciated that unfolding of the telescopic sunshade according to the preferred teachings of the present invention is achieved by moving control device 10 downward to cause downward movement of inner tube 40 from the upper position to the lower position together with hub assembly 58 and ribs 70. The weights of inner tube 40, hub assembly 58, and ribs 70 assist in the downward movement for unfolding operation. Thus, the telescopic sunshade according to the preferred teachings of the present invention can be unfolded easily and rapidly with less effort. Folding of the telescopic sunshade according to the preferred teachings of the present invention can also be achieved easily with larger force.

Now that the basic teachings of the present invention have been explained, many extensions and variations will be obvious to one having ordinary skill in the art. For example, upper and lower positioning holes 32 and 34 do not have to be aligned along first axis X. Furthermore, upper and lower positioning holes 32 and 34 can be spaced from restraining slot 26 by any desired angle. Further, control device 10 does not have to include jacket 128, cap 152, and coupling blocks 108. In this case, positioning button 56 is partially exposed outside of sleeve 96 for manual operation to disengage positioning button 56 from upper or lower positioning hole 32, 34 to allow movement of inner tube 40 along first axis X between the upper and lower positions. Further, opening 102 of sleeve 96 can be located intermediate top and bottom ends 100 and 98. In this case, positioning button 56 must be moved to the retracted position while mounting sleeve 96.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A telescopic sunshade comprising, in combination:

an outer tube including a first end and a second end spaced from and below the first end along a first axis perpendicular to a surface, with the outer tube adapted to be placed on the surface, with a first longitudinal hole extending from the first end through the second end of the outer tube along the first axis, with the outer tube further including an outer periphery extending between the first and second ends of the outer tube, with a restraining slot extending from the outer periphery of the outer tube through the first longitudinal hole in a radial direction perpendicular to the first axis, with the restraining slot including a first end and a second end spaced from and below the first end of the restraining slot along the first axis, with upper and lower positioning holes extending from the outer periphery of the outer periphery of the outer tube in the radial direction and spaced from the restraining slot by an angle in a circumferential direction about the first axis;

an inner tube slideably received in the first longitudinal hole of the outer tube between upper and lower positions spaced along the first axis, with the inner tube including upper and lower ends spaced along the first axis and an outer periphery extending between the upper and lower ends of the inner tube, with a second longitudinal hole extending from the upper end through the lower end of the inner tube along the first axis, with a through-hole extending from the outer periphery at the lower end of the inner tube through the second longitudinal hole in the radial direction perpendicular the first axis, with the upper end of the inner tube protruding upward beyond and having a spacing to the first end of the outer tube along the first axis when the inner tube is in either of the upper and lower positions, with the lower end of the inner tube being located in the outer tube when the inner tube is in either of the upper and lower positions, with the spacing between the first end of the outer tube and the upper end of the inner tube in the upper position being longer than that between the first end of the outer tube and the upper end of the outer tube in the lower position;

a positioning button slideably received in the through-hole of the inner tube between a retracted position received in one of the upper and lower positioning holes and a protruded position partially extending outside of one of the upper and lower positioning holes, with the positioning button being biased from the retracted position to the protruded position, with the positioning button aligned with the upper positioning hole when the inner tube is in the upper position, with the positioning button aligned with the lower positioning hole when the inner tube is in the lower position;

a hub fixed to the upper end of the inner tube to move therewith;

a plurality of ribs each having an end pivotably connected to the hub;

a runner slideably mounted to the outer tube along the first axis, with the runner located above the restraining slot along the first axis;

a plurality of stretchers each including a first end pivotably connected to the runner and a second end pivotably connected to one of the plurality of ribs;

a sleeve slideably mounted around the outer tube along the first axis, with the sleeve including top and bottom ends spaced along the first axis and an outer periphery extending between the top and bottom ends of the sleeve, with a central hole extending from the top end through the bottom end of the sleeve along the first axis, with an opening extending through the outer periphery of the sleeve to the central hole in the radial direction perpendicular to the first axis, with a first radial hole extending from the outer periphery of the sleeve through the central hole in the radial direction perpendicular to the first axis and spaced from the opening in the circumferential direction, with the first radial hole aligned with the restraining slot and within an extent of a length of the restraining slot along the first axis, with the positioning button located within an extent of the opening; and a follower extending through the first radial hole of the sleeve and the restraining slot of the outer tube and engaged with the inner tube, allowing joint sliding movement of the sleeve and the inner tube along the first axis restrained by the extent of the length of restraining slot, wherein when the inner tube is in the upper position, the telescopic sunshade is in a folded state, the positioning button is engaged in the upper positioning hole when the positioning button is in the protruded position, the positioning button is movable to the retracted position to disengage from the upper positioning hole to allow the inner tube to move from the upper position to the lower position together with the hub and the plurality of ribs, wherein when the inner tube is in the lower position, the telescopic sunshade is supported in an unfolded state by the plurality of ribs and the plurality of stretchers, the positioning button is engaged in the lower positioning hole when the positioning button is in the protruded position, the positioning button is movable to the retracted position to disengage from the lower positioning hole to allow the inner tube to move from the lower position to the upper position together with the hub and the plurality of ribs.

2. The telescopic sunshade as claimed in claim 1, with each of the upper and lower positioning holes spaced from the restraining slot along a second axis perpendicular to the first axis, with the upper and second positioning holes aligned with each other along the first axis.

3. The telescopic sunshade as claimed in claim 1, further comprising, in combination: a jacket rotatably mounted around the sleeve between a release position not pressing the positioning button and a pressing position pressing the positioning button, with the jacket including upper end and lower ends spaced along the first axis, with a compartment extending from the upper end through the lower end of the jacket along the first axis, with a pressing block formed on an inner periphery of the compartment and within the extent of the opening, with the pressing block spaced from the positioning button in the circumferential direction when the jacket is in the release position, with the pressing block moving the positioning button from the protruded position to the retracted position when the jacket is moving from the release position to the pressing position.

4. The telescopic sunshade as claimed in claim 3, with a protrusion formed on the inner periphery of the compartment of the jacket, with the protrusion including an arcuate inner surface having a radius slightly larger than a radius of the outer periphery of the sleeve, with the pressing block including a first stop face extending perpendicularly to the first axis, with the pressing block further including a pressing face connected to the first stop face and a guide face extending between the pressing face and the inner periphery of the compartment of the jacket, with the pressing face extending in the circumferential direction about the first axis and having a radius the same as the radius of the outer periphery of the sleeve and coaxial to the inner periphery of the compartment of the jacket, with the guide face having decreasing spacing from the inner periphery of compartment towards the pressing face, with the guide face having a disengagement edge flush with the inner periphery of compartment, with the disengagement edge aligned with the positioning button when the jacket is in the release position, with the positioning button being pressed by the guide face and moved from the protruded position to the retracted position when the jacket is rotated from the release position to the pressing position, with the pressing face pressing against and retaining the positioning button in the retracted position when the jacket is in the pressing position.

5. The telescopic sunshade as claimed in claim 4, with a stop being formed on the inner periphery of the compartment of the jacket and below the protrusion, with the stop including a second stop face extending perpendicularly to the first axis, with the opening including first and second edges spaced in the circumferential direction, with the pressing block and the stop located intermediate the first and second edges of the opening, with the first stop face of the pressing block abutting the first edge of the opening when the jacket is in the release position, with the second stop face of the stop abutting the second edge of the opening when the jacket is in the pressing position.

6. The telescopic sunshade as claimed in claim 5, with the compartment of the jacket including an upper enlarged section in the upper end of the compartment and above the pressing block along the first axis, with the opening extending from the bottom end towards but spaced from the top end of the sleeve along the first axis, with the sleeve further including a flange on the top end, with the flange of the sleeve received in the upper enlarged section of the compartment of the jacket.

7. The telescopic sunshade as claimed in claim 6, with the compartment of the jacket further including a lower enlarged section at the lower end of the compartment and below the stop along the first axis, with the bottom end of the sleeve including a plurality of coupling blocks formed on the outer periphery of the sleeve, with the arcuate inner surface of the protrusion of the jacket including a plurality of channels, with the plurality of coupling blocks passable through the plurality of channels and located below the protrusion along the first axis, with a cap rotatably received in the lower enlarged section, with a plurality of fasteners extending through the cap into the plurality of coupling blocks, preventing the jacket from moving relative to the sleeve along the first axis.

8. The telescopic sunshade as claimed in claim 7, with the flange of the sleeve including a recess, with a spring received in the recess and including two tangs respectively fixed to the sleeve and the jacket, with the spring biasing the jacket from the pressing position to the release position.

* * * * *